US006601680B2

(12) United States Patent
Japchen

(10) Patent No.: US 6,601,680 B2
(45) Date of Patent: Aug. 5, 2003

(54) CARRYING CASE

(76) Inventor: David R. Japchen, 1370 Industry Rd., Hatfield, PA (US) 19440

( * ) Notice: Subject to any disclaimer, the term of this patent is extended or adjusted under 35 U.S.C. 154(b) by 0 days.

(21) Appl. No.: 10/033,568

(22) Filed: Jan. 2, 2002

(65) Prior Publication Data

US 2003/0121741 A1 Jul. 3, 2003

(51) Int. Cl.[7] ..... A45C 13/00; A45C 13/13; B65D 81/05

(52) U.S. Cl. ..... 190/120; 190/101; 206/317; 206/523

(58) Field of Search ..... 190/102, 119, 190/120, 101; 206/317, 523; 70/64, 65, 67, 75, 49; 292/283; 224/913

(56) References Cited

U.S. PATENT DOCUMENTS

| | | | | | |
|---|---|---|---|---|---|
| 1,022,811 | A | | 3/1912 | Binkley | |
| 1,299,291 | A | * | 4/1919 | Blanke | 190/119 X |
| 1,570,500 | A | * | 1/1926 | Kennedy | 206/315.6 |
| RE16,643 | E | | 5/1927 | Luce | |
| 2,324,638 | A | * | 7/1943 | O'Connor | 70/65 |
| 2,706,036 | A | * | 4/1955 | Neal | 206/315.7 |
| 2,729,088 | A | | 1/1956 | Huot et al. | |
| 2,781,897 | A | * | 2/1957 | Dale | 206/315.7 |
| 4,643,302 | A | * | 2/1987 | Baumgardner | 190/119 X |
| 4,792,026 | A | | 12/1988 | Dimmick et al. | |
| 5,172,575 | A | | 12/1992 | Fisher | |
| 5,475,995 | A | * | 12/1995 | Livingston | 70/259 |
| 6,135,277 | A | * | 10/2000 | Armstrong | 206/317 X |
| 6,217,042 | B1 | * | 4/2001 | Kurtz et al. | 206/315.6 X |

FOREIGN PATENT DOCUMENTS

| | | | | |
|---|---|---|---|---|
| FR | 2499946 | * | 8/1982 | 190/119 |
| GB | 381424 | * | 10/1932 | 206/315.4 |
| SU | 349605 | * | 9/1972 | 190/119 |

* cited by examiner

*Primary Examiner*—Sue A. Weaver
(74) *Attorney, Agent, or Firm*—Zachary T. Wobensmith, III

(57) ABSTRACT

A carrying case for storing and carrying items of high value and/or potentially dangerous items such as firearms, which has an improved, latching mechanism and a reinforced case construction.

3 Claims, 5 Drawing Sheets

CARRYING CASE

BACKGROUND OF THE INVENTION

1. Field of the Invention

This invention relates to a carrying case, and more particularly to a carrying case of the type that incorporates an improved locking mechanism and case construction to provide a more secure case.

2. Description of the Prior Art

Carrying cases that provide improved security, as well as easy access and protection for high value and/or potentially dangerous items such as firearms, are much desired. Such cases are often subjected to severe service by being dropped and thrown around, particularly when loaded and unloaded onto airplanes and trucks. The cases must be resistant to these forces as well as providing a case that is highly resistant to access by thieves and other opportunists. In addition the weight of the case must be minimized consistent with the level of security desired.

Various carrying cases have been proposed, such as those described in U.S. Pat. Nos. RE 16,643; 1,022,817; 2,729,088; 4,792,026; and 5,172,575, but none of them is wholly satisfactory.

This invention is directed to a carrying case of improved construction, with a reinforced top and bottom, a full-length hinge, a latching mechanism that is of improved construction, and which provides easy access, and visual confirmation that the case is secured.

SUMMARY OF THE INVENTION

This invention relates to a carrying case for high value items that is of improved construction, with an improved latching mechanism that is easy to access, and provides visual confirmation of the security of the case.

The principal object of the invention is to provide a carrying case which has an improved latching mechanism.

A further object of the invention is to provide a carrying case that is of sturdy construction.

A further object of the invention is to provide a carrying case that can be used with a variety of items.

A further object of the invention is to provide a carrying case that will safely store one or more items of high value and/or of potential danger.

A further object of the invention is to provide a carrying case that provides visual indication of the case being secured.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
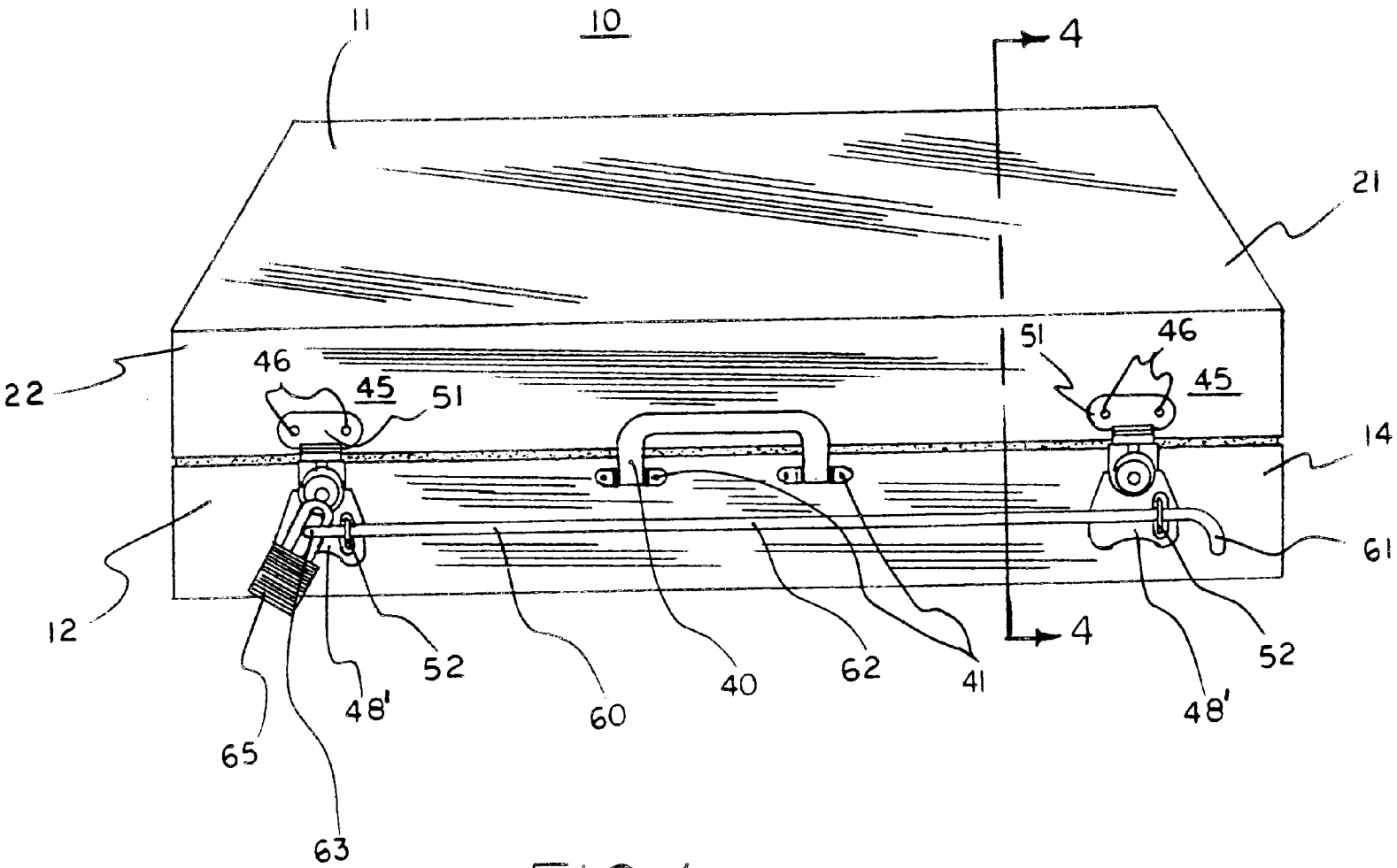
FIG. 1 is a front elevational view of a carrying case incorporating the elements of the invention, in closed condition.

It should, of course, be understood that the description and drawings herein are merely illustrative and that various modifications and changes can be made in the structures disclosed without departing from the spirit of the invention.

DESCRIPTION OF THE PREFERRED EMBODIMENTS

When referring to the preferred embodiments, certain terminology will be utilized for the sake of clarity. Use of such terminology is intended to encompass not only the described embodiments, but also technical equivalents which operate and function in substantially the same way to bring about the same result.

Referring now more particularly to the drawings and FIGS. 1 and 3–5 thereof, a carrying case 10 in accordance with the invention is therein illustrated.

The case 10 has a top or lid 11, and a bottom 12. The bottom 12 has a front panel 14, side panels 15 and 16, a rear panel 17, and a bottom panel 18. The top or lid 11 has a top panel 21, a front panel 22, side panels 23 and 24, and a rear panel 25. The top 11, and bottom 12 are constructed of aluminum or stainless steel, with the described panels 14, 15, 16, 17 and 18, and panels 21, 22, 23, 24 and 25, fastened together by welding in well known manner The top 11 and bottom 12 are secured together at the rear panels 17 and 25 by a full length piano hinge 26, of well known type, and preferably of aluminum or stainless steel, which is attached to panels 17, and 25 by flush mounted threaded studs 27, which extend through the hinge 26, and have lock washers 28 and locking nuts 29 thereon.

The bottom 12 has a resilient lining 30 thereon, between panels 14, 15, 16, 17 and 18, which may have a cut-out 35 therein, suitable to receive a pistol (not shown). The lining 30 may be of any suitable material, with any closed cell dense foam being suitable, and which is preferably glued to the bottom 12 by any well known suitable adhesive.

The top 11 is also provided with a resilient lining 36 which is also preferably a closed cell dense foam and adhesively secured to panel 21.

The top 11 is provided with a die cut watertight gasket 38, which extends around the top 11 on panels 22, 23, 24 and 25, which is in contact with panels 14, 15, 16 and 17 when the case 10 is in closed condition.

The bottom 12 has a carrying handle 40 of well known type (attached) to front panel 22 by screws 41, which extend through front panel 22.

The front panel 22 is also provided with a plurality of latch assemblies 45, which are fastened to the panel by flush mounted threaded studs 46 extending therethrough, with lock washers 47 and locking nuts 48 thereon.

The latch assemblies 45 are preferably Model K3-2403-07 available from South Co., and include a hasp 48' pivotally mounted to an anchor plate 49, which has the studs 46 extending therethrough.

The hasp 48' has a curved end 50, which can engage a keeper 51, of top 11 in closed condition, which keeper is attached to front panel 22 with a loop 52 from plate 49 extending through a slot 53 in hasp 48' in closed condition.

Figure 5:
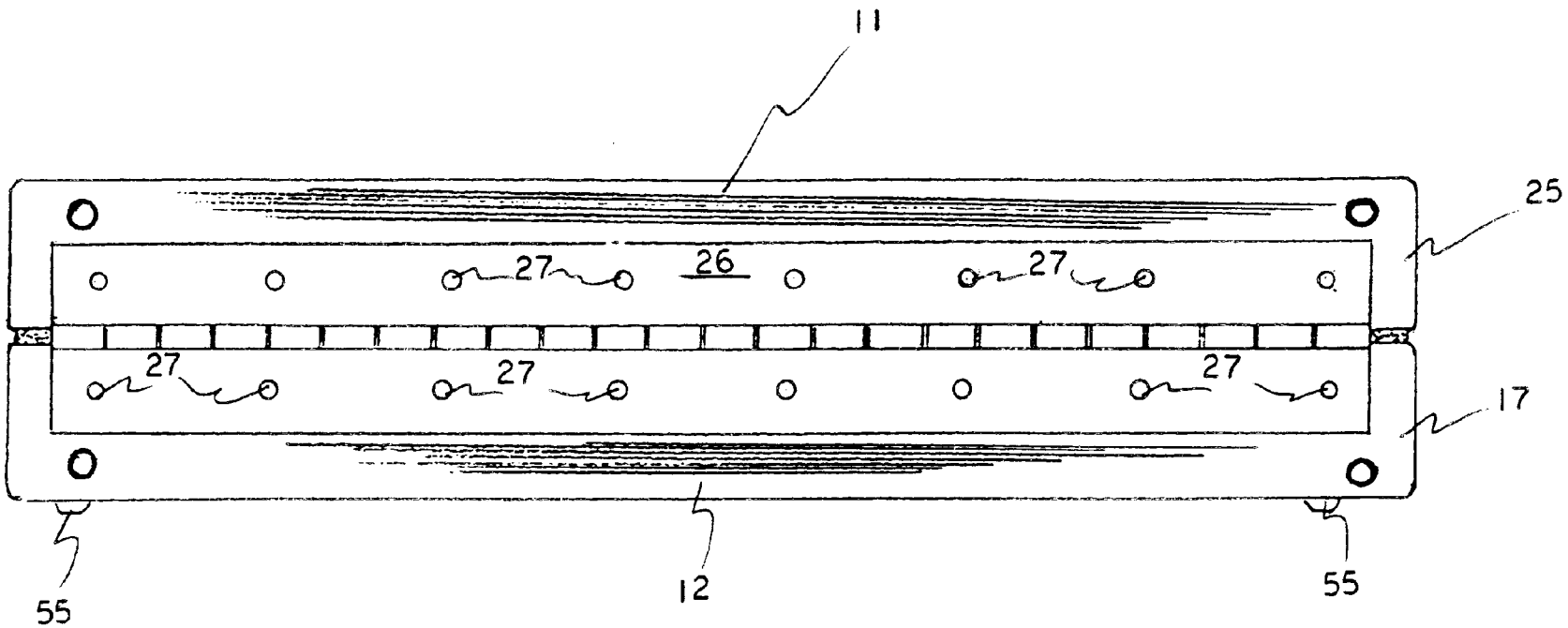
FIG. 5 is a rear elevational view of the case of FIG. 1.

A locking rod 60 is provided, preferably of stainless steel, which has a curved end 61, a straight center 62 and a flat end 63. The flat end 63 has a hole (not shown) therein, which is adapted to receive a padlock 65 of well known type, to retain rod 60 in loops 52 of latch assemblies 45 and secure the case 10 in closed condition. As shown in FIG. 5 a plurality of feet or bumpers 55 are provided, four being preferred and attached to bottom panel 18 of bottom 12.

Figure 2:
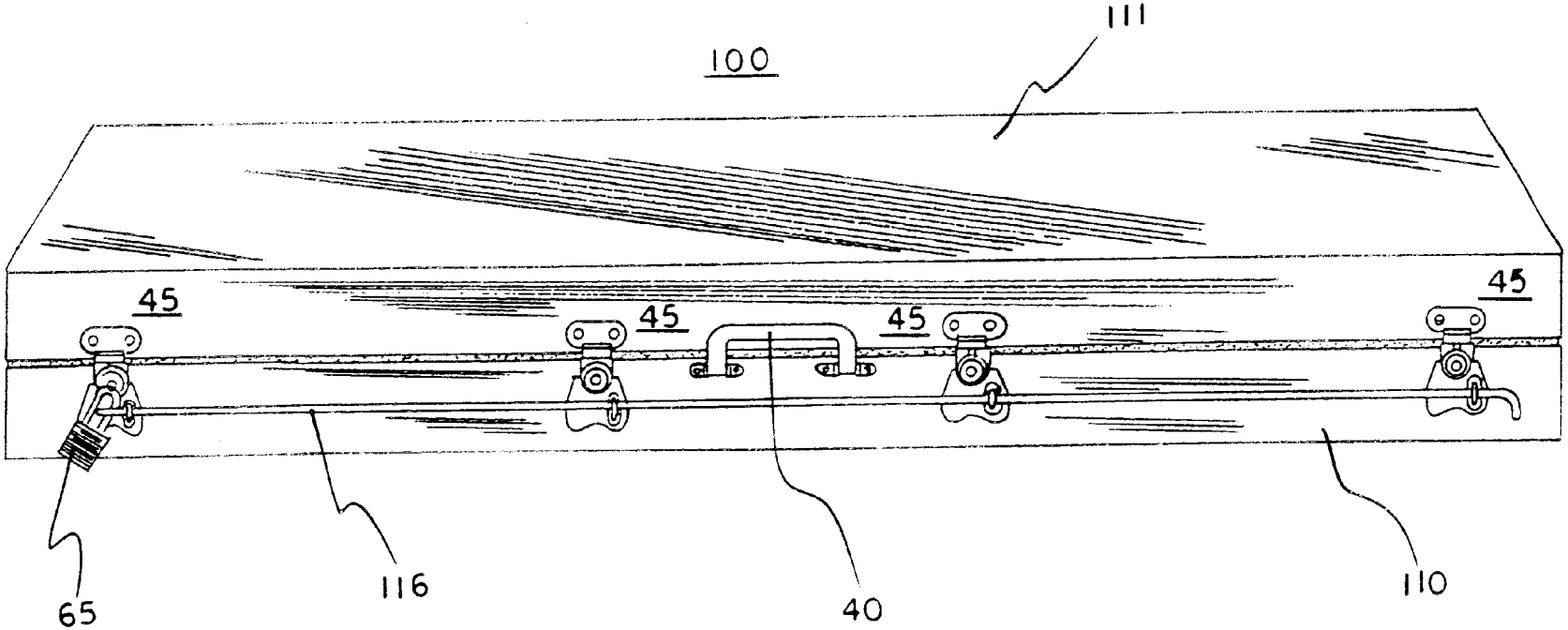
FIG. 2 is a view similar to FIG. 1 illustrating another embodiment of the carrying case of the invention.
Figure 3:
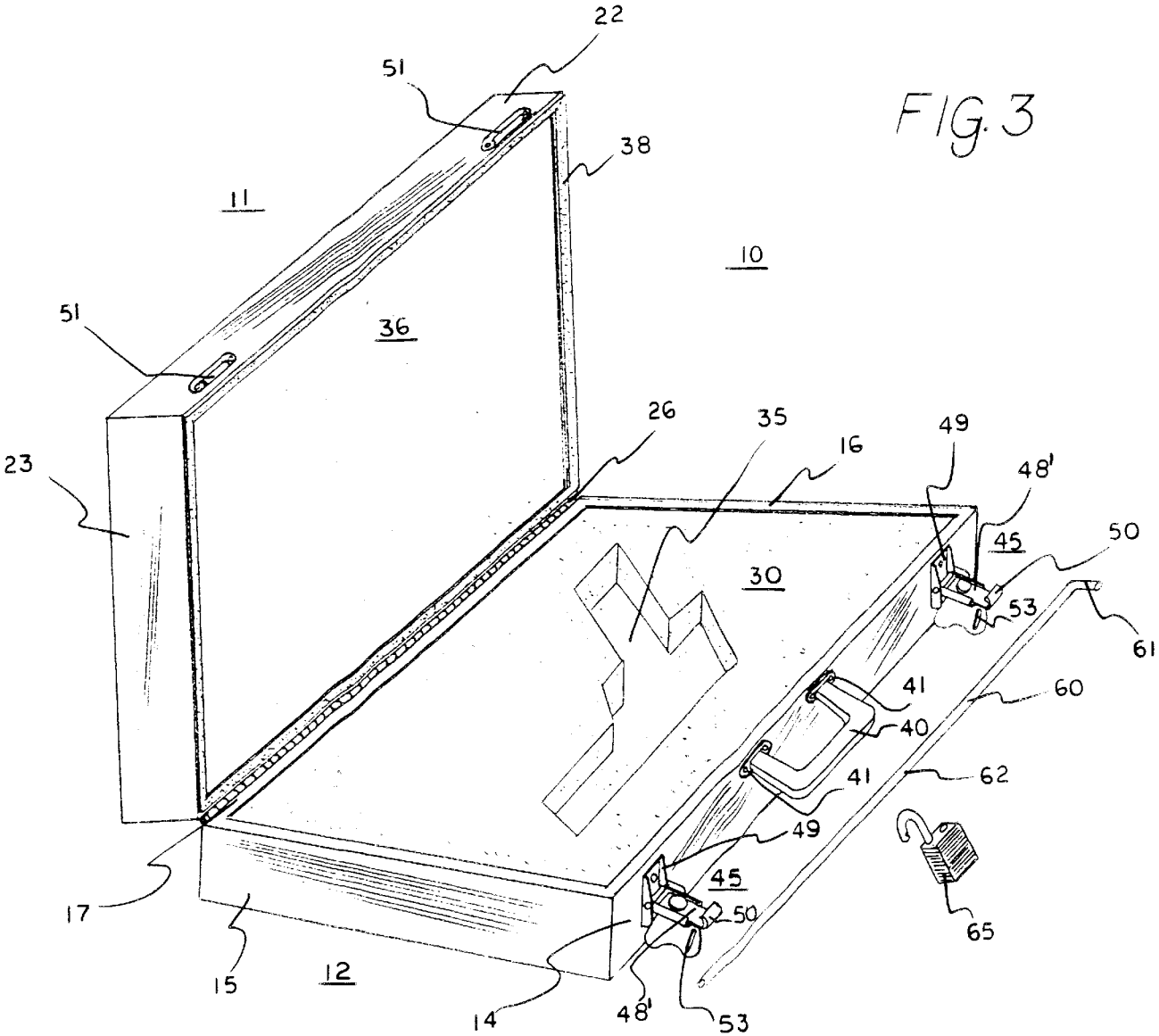
FIG. 3 is a perspective side view of the case of FIG. 1 in open condition.
Figure 4:
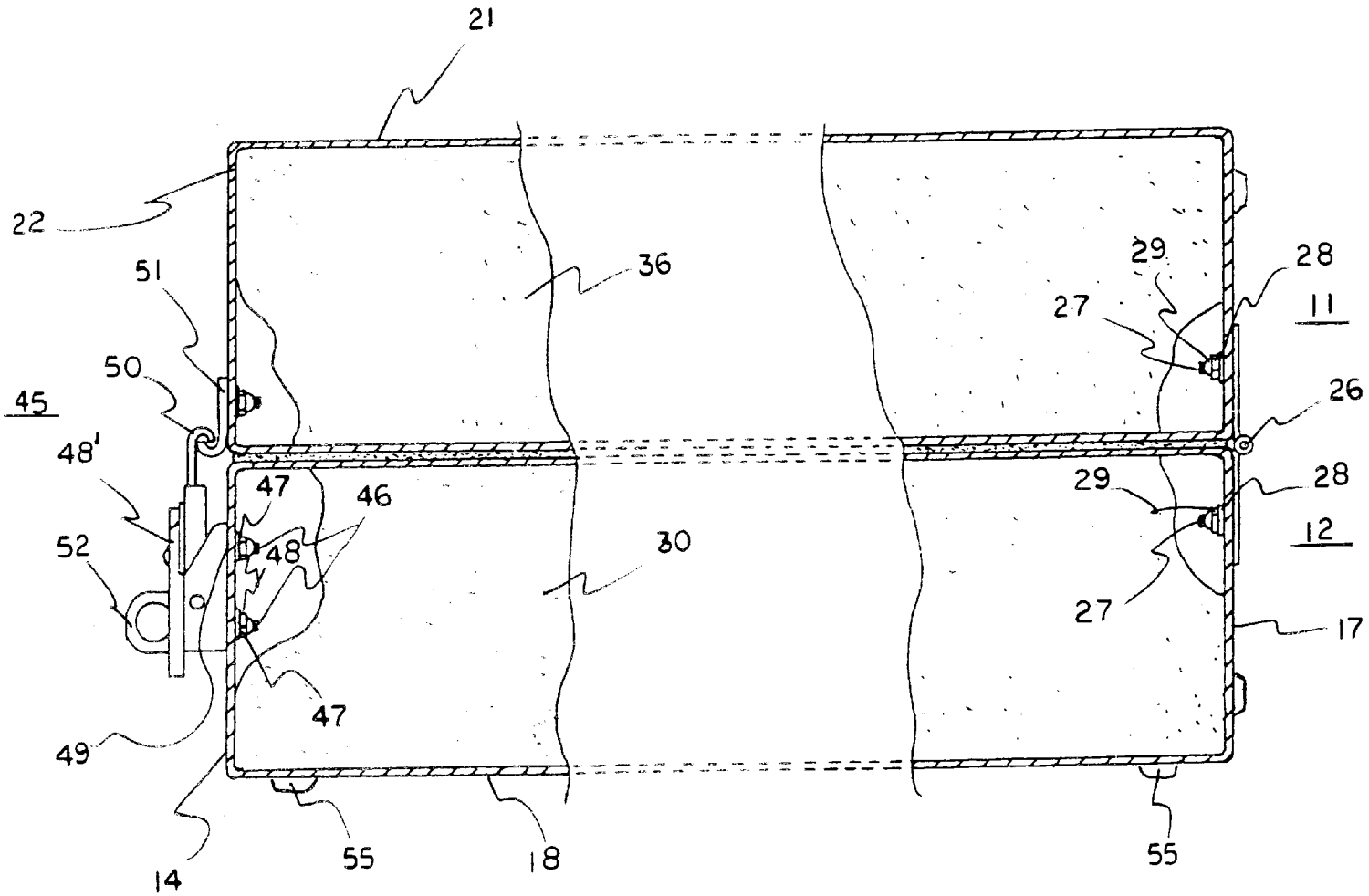
FIG. 4 is a vertical sectional view, enlarged, taken approximately on the line 4—4 of FIG. 1.

Referring now to FIG. 2, a case 100 is therein illustrated, which has a bottom 110, and a lid or top 111, secured together by a piano hinge (not shown) similar to hinge 26 of case 10. Case 100 is of the same construction as case 10, but is of greater length to accommodate a rifle (not shown) or other lengthy item. Case 100 is also provided with a greater number of latch assemblies 45, four being illustrated and with a longer locking rod 116.

In use the hasps 48' are disengaged from the keepers 51, and the top 10 or 111 raised. The gun or other item (not shown) is placed on the bottom resilient lining 30 and the top 10 or 111 closed. The hasps 48 are engaged with keepers 51, and locking rod 60 or 116 is engaged in loops 52, and the padlock 65 engaged with the locking rod. The case 10 or 100 is now suitable for carrying or storage of the items therein until it is desired to open the case, whereby the operation is repeated.

It will thus be seen that structure has been provided with which the objects of the invention are achieved.

I claim:

1. A carrying case for safely carrying and storing firearms or other high value items which includes a bottom, having a back panel, side panels, a bottom panel, and a front panel, a top or lid having a front panel, top panel, side panels and a back panel, a hinge connecting said back panels to each other, the improvement which comprises:

said front panel of said bottom having a plurality of latch assemblies thereon, said latch assemblies including anchor plates attached to said front panel, hasps pivotally attached to said anchor plates, said front panel of said top having keepers attached thereto, said hasps having curved ends adapted to engage said keepers to secure said top and bottom together, said anchor plates having loops extending therefrom, said hasps having slots for passage of said loops, a removable locking rod for engagement with said loops when said hasps are engaged with said loops, said locking rod having a curved end and a flat end, said flat end having a hole therein, a padlock for engagement in said hole to retain said locking rod from removal from said loops, said top having a water proof gasket, and said top and said bottom each having resilient linings therein.

2. A carrying case as defined in claim 1 in which, said bottom, said top or lid, and said hinge are of aluminum or stainless steel.

3. A carrying case as defined in claim 1 in which, said bottom panel of said bottom has a plurality of feet thereon.

* * * * *